US006692068B1

(12) United States Patent
Tang

(10) Patent No.: US 6,692,068 B1
(45) Date of Patent: Feb. 17, 2004

(54) DECK CHAIR

(76) Inventor: Lai-Fu Tang, No. 112, Lane 80, Chien Ping Liow St., Tainan (TW)

( * ) Notice: Subject to any disclaimer, the term of this patent is extended or adjusted under 35 U.S.C. 154(b) by 0 days.

(21) Appl. No.: 10/358,296

(22) Filed: Feb. 5, 2003

(51) Int. Cl.[7] ..... A47C 4/30; A47C 20/04; A47C 7/50

(52) U.S. Cl. ..... 297/16.2; 297/19; 297/21; 297/27; 297/30; 297/38; 297/39; 297/423.26; 297/423.3

(58) Field of Search ..... 297/16.2, 19, 21, 297/22, 27, 30, 35, 38, 39, 423.26, 423.3

(56) References Cited

U.S. PATENT DOCUMENTS

| | | | | | |
|---|---|---|---|---|---|
| 451,475 | A | * | 5/1891 | Forsyth | 297/19 |
| 1,303,012 | A | * | 5/1919 | Bailly | 297/19 |
| 2,195,091 | A | * | 3/1940 | Lorenz et al. | 297/27 |
| 2,333,761 | A | * | 11/1943 | Beeskow | 297/27 |
| 2,560,985 | A | * | 7/1951 | Rideout | 297/27 |
| 2,571,463 | A | * | 10/1951 | Lorenz | 297/30 |
| 2,638,970 | A | * | 5/1953 | Harber | 297/27 |
| 2,649,138 | A | * | 8/1953 | Rechler | 297/21 |
| 3,269,767 | A | * | 8/1966 | Marzocchi | 297/39 |
| 4,072,341 | A | * | 2/1978 | Kurz | 297/27 |
| 4,792,181 | A | * | 12/1988 | Guichon | 297/30 X |
| 4,898,421 | A | * | 2/1990 | Brunn | 297/35 X |
| 5,294,171 | A | * | 3/1994 | Horng | 297/35 X |
| 5,335,967 | A | * | 8/1994 | Vanderminden, Sr. | 297/35 |
| 5,570,926 | A | * | 11/1996 | Papiernik et al. | 297/27 X |
| 5,855,409 | A | * | 1/1999 | Tseng | 297/27 X |
| 6,382,727 | B1 | * | 5/2002 | Pickard | 297/30 X |
| 6,502,899 | B2 | * | 1/2003 | Tseng | 297/39 X |
| 2002/0121800 | A1 | * | 9/2002 | Yu | 297/27 |

* cited by examiner

*Primary Examiner*—Rodney B. White
(74) *Attorney, Agent, or Firm*—Rosenberg, Klein & Lee

(57) ABSTRACT

A deck chair has a frame having a back frame, a seat frame, a leg frame, a front support frame, a rear support frame outside the back frame and two side stretchers. Two positioning members pivotally mount the back frame to the seat. Two armrest-adjusting members are respectively pivotally mounted at top ends of the front support frame and the rear support frame. When the positioning members are locked, the back frame and the seat frame can be pivoted about the positioning members with a changeless included angle.

11 Claims, 12 Drawing Sheets

DECK CHAIR

BACKGROUND OF THE INVENTION

1. Field of the Invention

The present invention is related to a deck chair, and more particularly to a deck chair of which a back frame and a seat frame can be pivoted together with a changeless included angel.

2. Description of Related Art

Referring to FIG. 12, a conventional deck chair has a back frame (61) pivotally mounted with a seat frame (62). Two front supports (63) are respectively pivotally mounted at two sides of the seat frame (62). Two rear supports (64) are respectively pivotally mounted with the front supports (63) at top ends thereof. A leg frame (65) is pivotally mounted at a front end of the seat frame (62), and connected with the back frame (61) by two linkages (66). Two armrests (67) are respectively mounted at top ends of the front supports (63) and the rear supports (64).

Referring to FIG. 13, the armrests (67) each have a plurality of teeth (661) selectively engaged with a stop (662) on the top ends of the supports (64, 65). A user can pivot the back frame (61) downwards to lie down the back.

However, when the back frame (61) is pivoted, an included angle ( ) between the back frame (61) and the seat frame (62) is varied, so the user will fell uncomfortable.

Therefore, the invention provides a deck chair to mitigate and/or obviate the aforementioned problems.

SUMMARY OF THE INVENTION

The main objective of the invention is to provide a deck chair which a back frame and a seat frame can be pivoted together with a changeless included angel.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
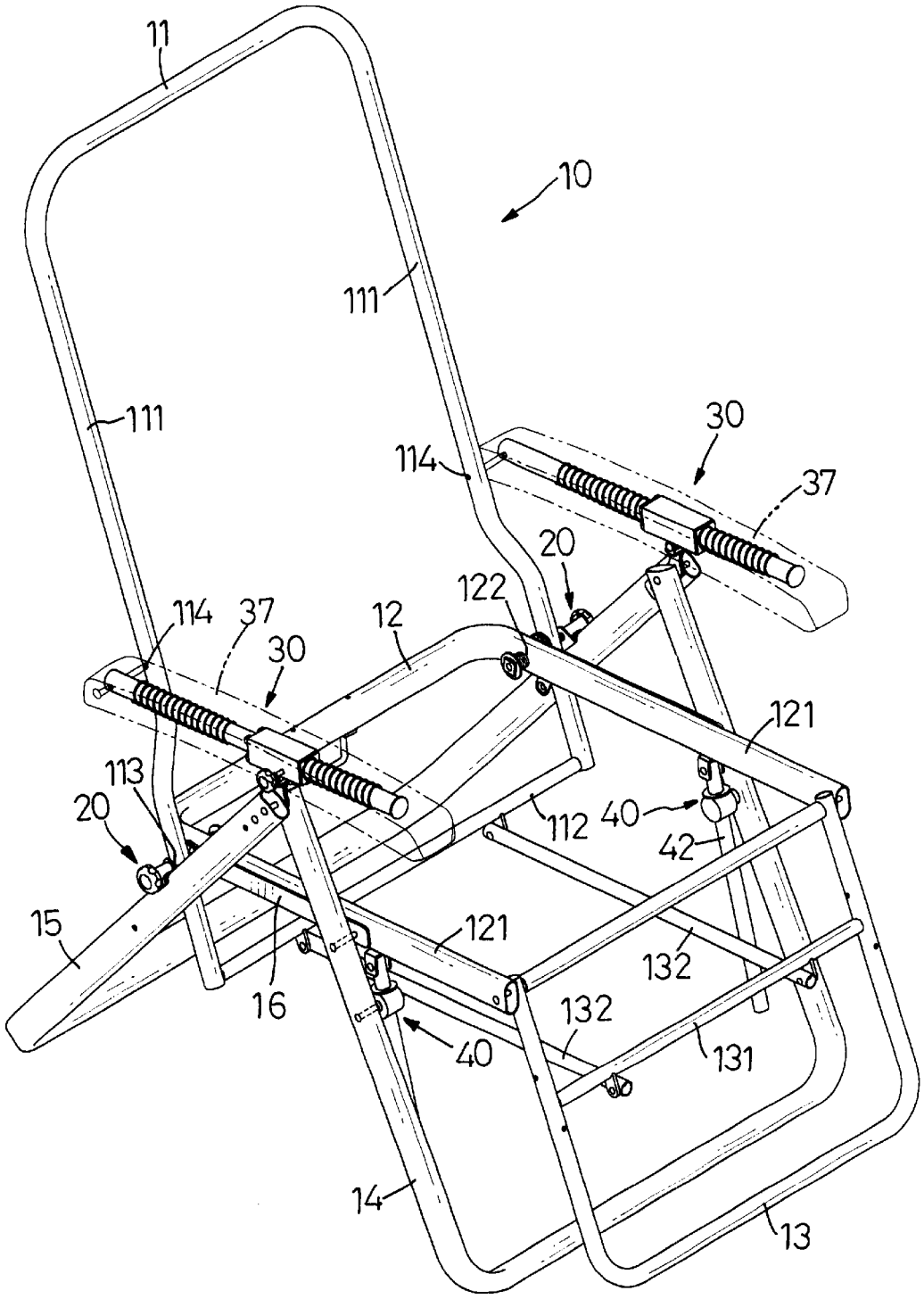
FIG. 1 is a perspective view of a deck chair in accordance with the invention.

Referring to FIG. 1, a deck chair in accordance with the invention is composed of a frame (10), two positioning members (20), two armrest-adjusting members (30), and two pivoting members (40).

The frame (10) has aback frame (11) with two upright bars (111) and a lateral bar (not numbered) integrally formed between the upright bars (111). A first linkage (112) is transversally connected between lower ends of the upright bars (111). The upright bars (111) each have a first hole (113) and a second hole (114) above the first hole (113) defined therethrough. A seat frame (12) is pivotally mounted to the back frame (11) at the first holes (113). The seat frame (12) has two longitudinal bars (121), and two non-circular holes (122) respectively defined through the longitudinal bars (121) and aligned with the first holes (113). A leg frame (13) is pivotally mounted at a front end of the seat frame (12). A front stretcher (131) is provided in the leg frame (13), and connected with the first linkage (112) by two second linkages (132). A front support frame (14) is pivotally mounted outside the seat frame (12), and a rear support frame (15) outside the back frame (11) has top ends pivotally mounted with top ends of the front support frame (14). Two side stretchers (16) each have a front end mounted on the front support frame (14), and a rear end mounted between the respective first hole (113) and non-circular hole (122).

Figure 2:
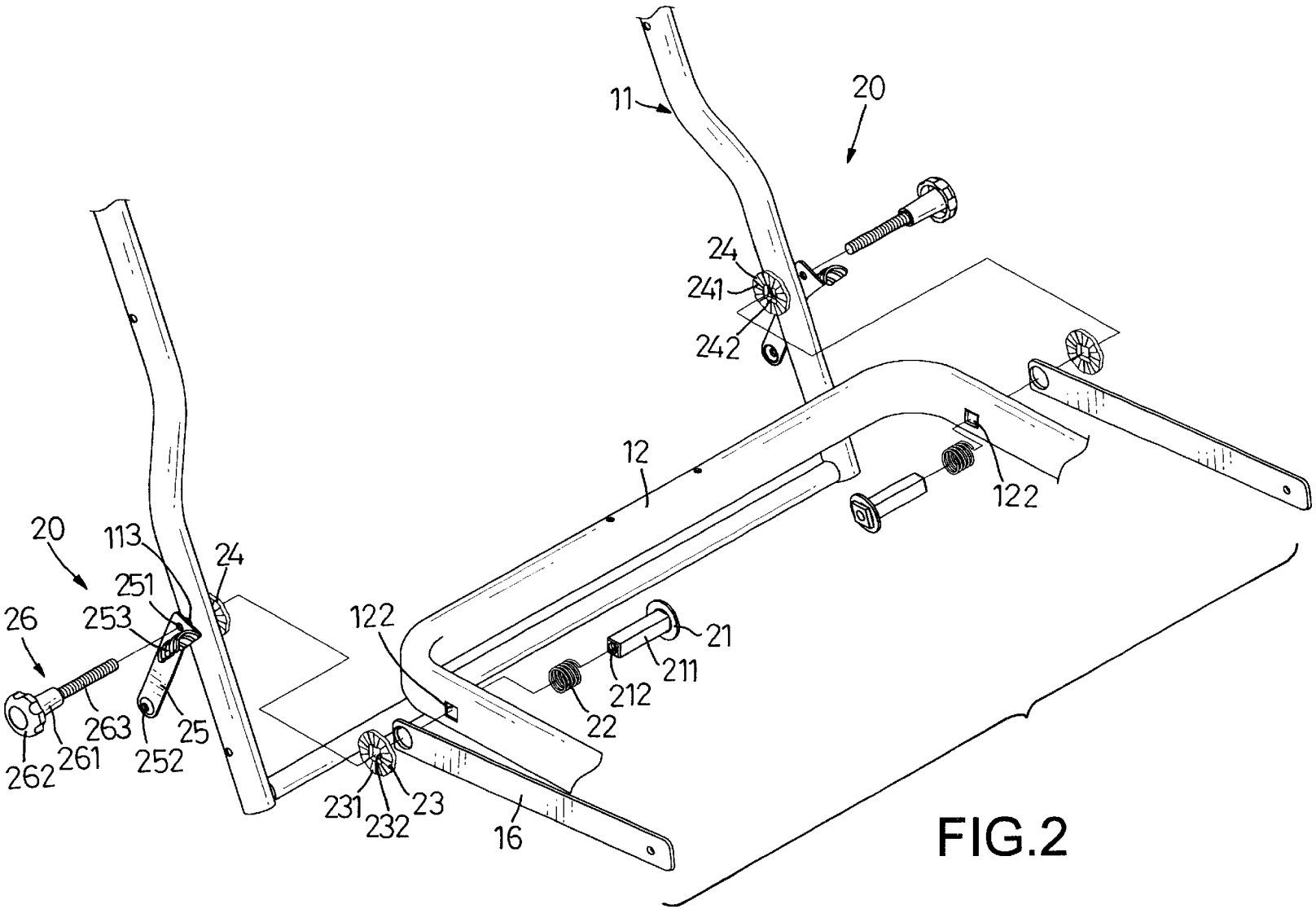
FIG. 2 is an exploded perspective view of positioning members of the deck chair in FIG. 1.
Figure 5:
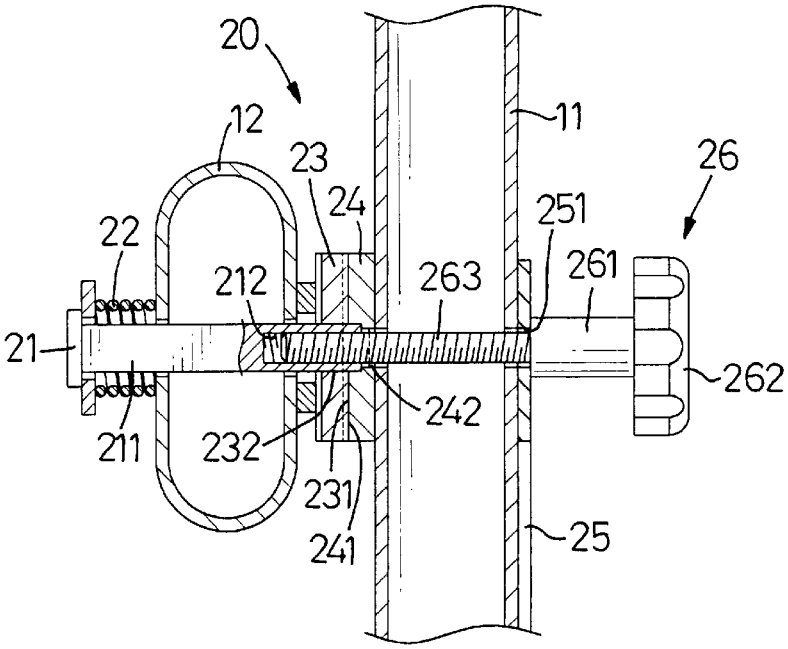
FIG. 5 is a cross-sectional view of the positioning member in a locked status.

The positioning members (20) are respectively mounted in the first holes (113) and the non-circular holes (122). Referring to FIGS. 1, 2 and 5, each of the positioning members (20) has a shaft (21) with a non-circular shank (211) inserted through the respective non-circular hole (122) from an inside of the seat frame (12). The shaft (21) has a threaded hole (212) defined through the shank (211) of the shaft (21). A first resilient member (22) is provided outside the shank (211) and between the longitudinal bar (121) and the shaft (21). A first disk (23) and a second disk (24) are provided between the longitudinal bar (121) and the upright bar (111), and each have a non-circular aperture (232, 242) for the shank (211) extending through the apertures (232, 242). The firs disk (23) has a plurality of first teeth (231) engaged with a plurality of second teeth (241) formed on the second disk (24). The side stretcher (16) is provided between the first disk (23) and the longitudinal bar (121).

A link (25) is pivotally mounted on the longitudinal bar (121) by a knob (26). The link (25) has a first pin hole (251) defined at an upper end thereof and aligned with the first hole (113) and a second pin hole (252) defined at a lower end thereof. An ear (253) is formed at the upper end of the link (25) for abutting the rear support frame (15). The knob (26) has a smooth part (261), a grip (262) and a threaded part (263). The threaded part (263) is in turn inserted through the first pin hole (251), the first hole (113), the non-circular apertures (241, 231), the non-circular hole (122), and engaged in the threaded hole (212) to fasten the positioning member (20) on the back frame (11) and the seat frame (12).

Figure 3:
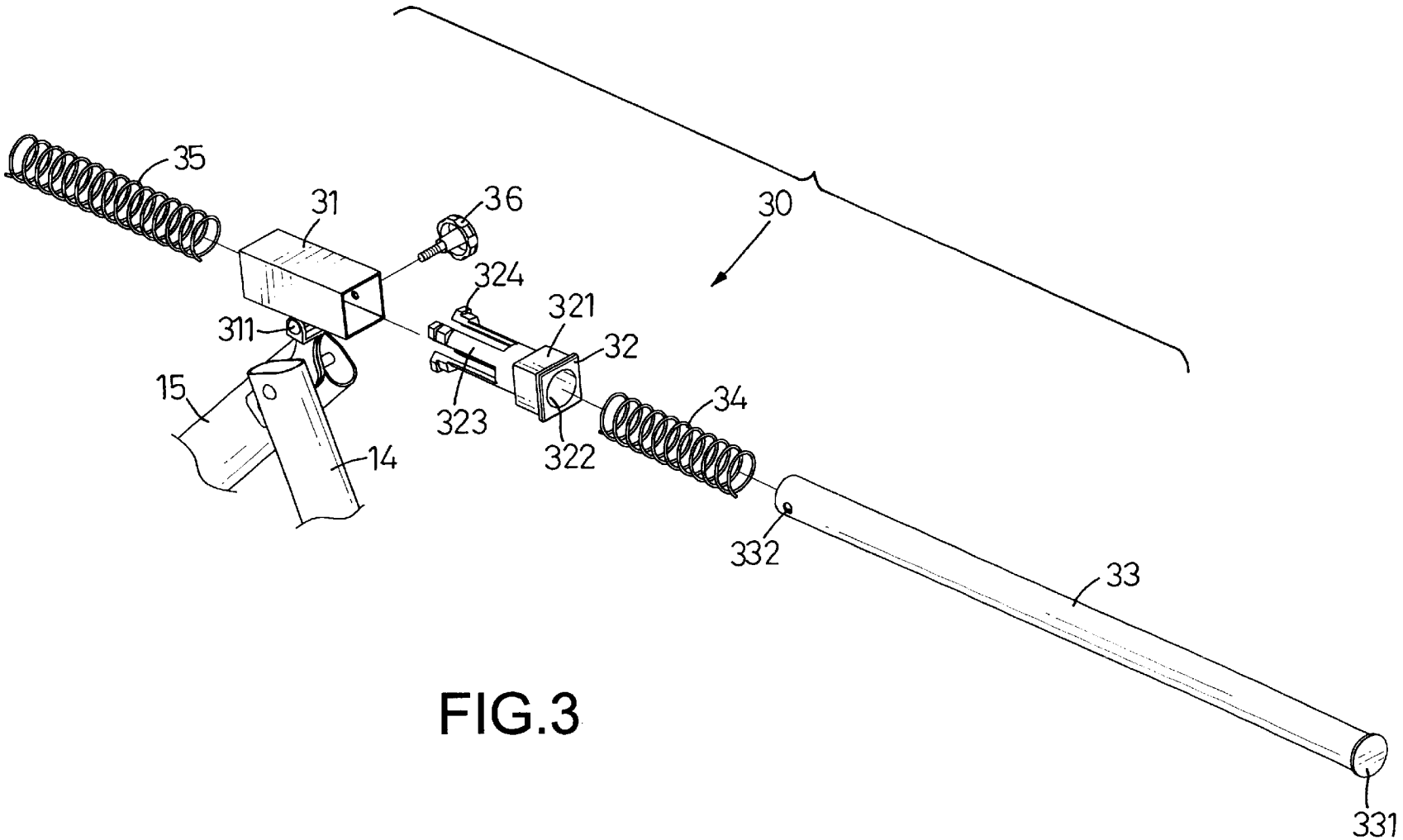
FIG. 3 is an exploded perspective view of an armrest-adjusting member of the deck chair in FIG. 1.

Referring to FIGS. 1 and 3, the armrest-adjusting member (30) has a tube (31) pivotally mounted on the top ends of the front support frame (14) and the rear support frame (15) by a pivoting piece (311) formed at a bottom of the tube (31) and between the front support frame (14) and the rear support frame (15). A sleeve (32) is received in the tube (31), and has a head (321) located at a front end of the tube (31) and a first opening (322) defined through the head (321). A plurality of fingers (323) extend rearwards from the head (321), and a barb (324) is formed at a distal end of the respective finger (323) to attach a rear end of the tube (31). A first rod (33) is inserted through the first opening (322) and the tube (31). A stop (331) is formed at a front end of the first rod (33), and a third pin hole (332) is defined at a rear end of the first rod (33) and aligned with the second hole (114). A second resilient member (34) is provided outside the first rod (33) and between the stop (331) and the sleeve (32), and a third resilient member (35) is provided outside the first rod (33) and between the sleeve (32) and the third pin hole (332). A pin (not numbered) is inserted through the second hole (114) and the third pin hole (332) to connect the first rod (33) to the back frame (10). The armrest-adjusting member (30) further has a bolt (36) engaged in the tube (31) for fastening the first rod (33) in the tube (31). An armrest (37) is mounted on the tube (31).

Figure 4:
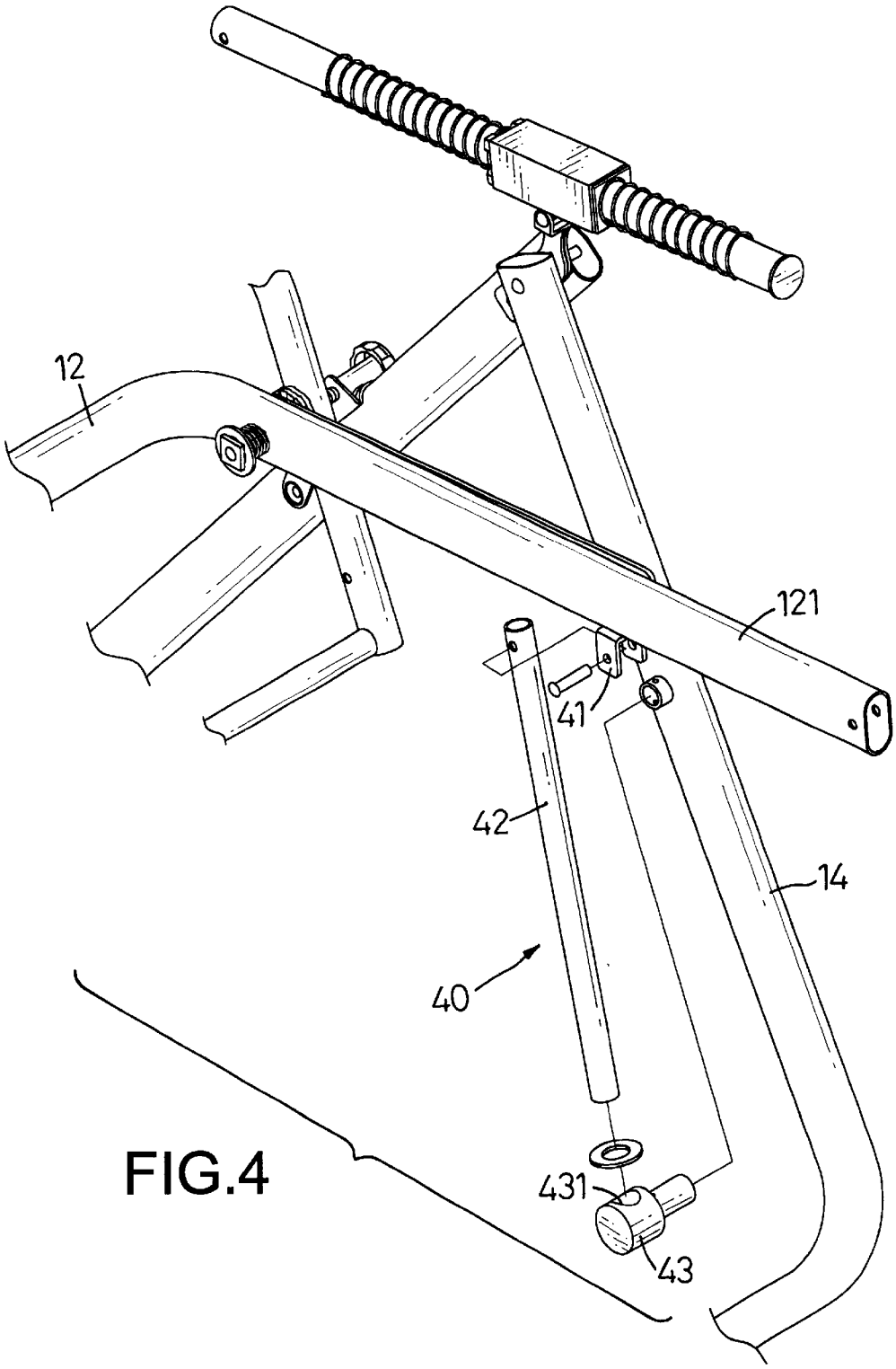
FIG. 4 is an exploded perspective view of a pivoting member of the deck chair in FIG. 1.

Referring to FIGS. 1 and 4, the pivoting members (40) are respectively mounted between the longitudinal bars (121) and the front support frame (14). Each of the pivoting members (40) has a U-like seat (41) formed under the respective longitudinal bar (121). A second rod (42) is pivotally mounted in the U-like seat (41) by a pin (not numbered) inserted through an upper end of the second rod (42). A rotating piece (43) is rotatably provided at an inner side of the front support frame (14), and has a second opening (431) defined through the rotating piece (43). The second rod (42) extends through the second opening (431).

Figure 6:
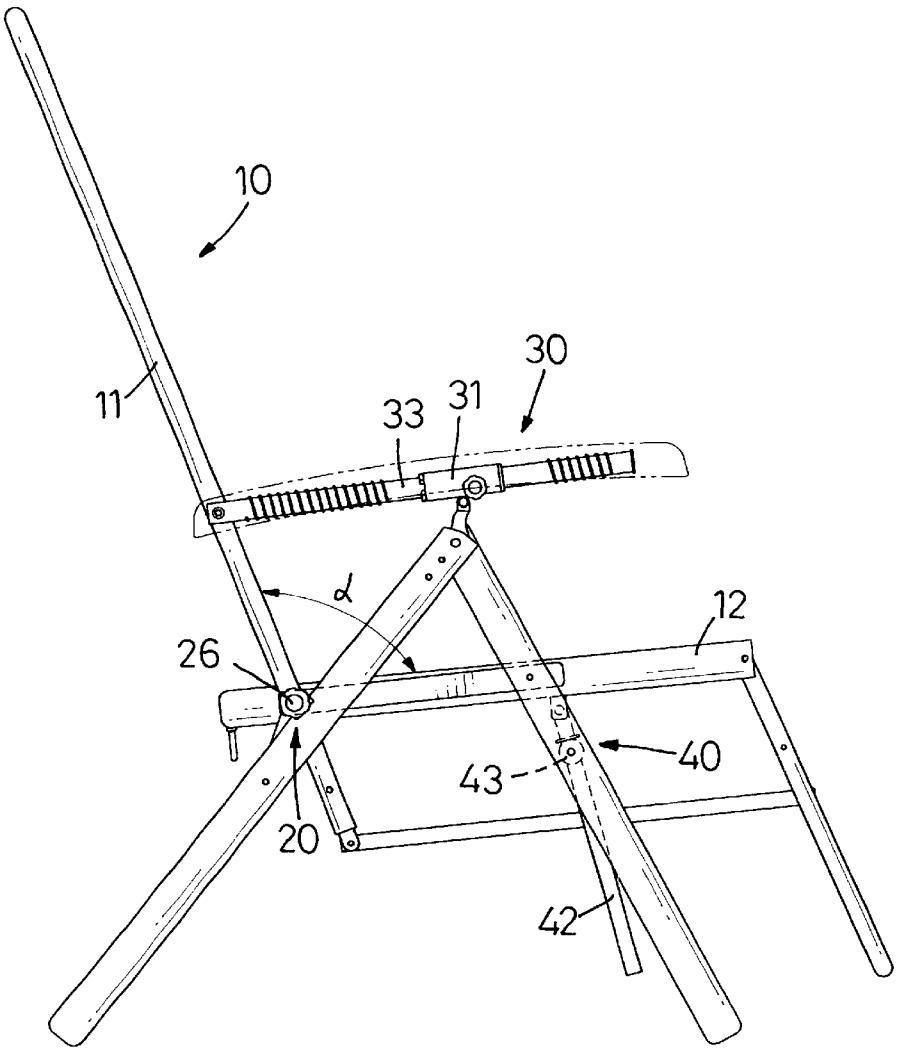
FIG. 6 is a side view of the deck chair with an included angle between a back frame and a seat frame.
Figure 7:
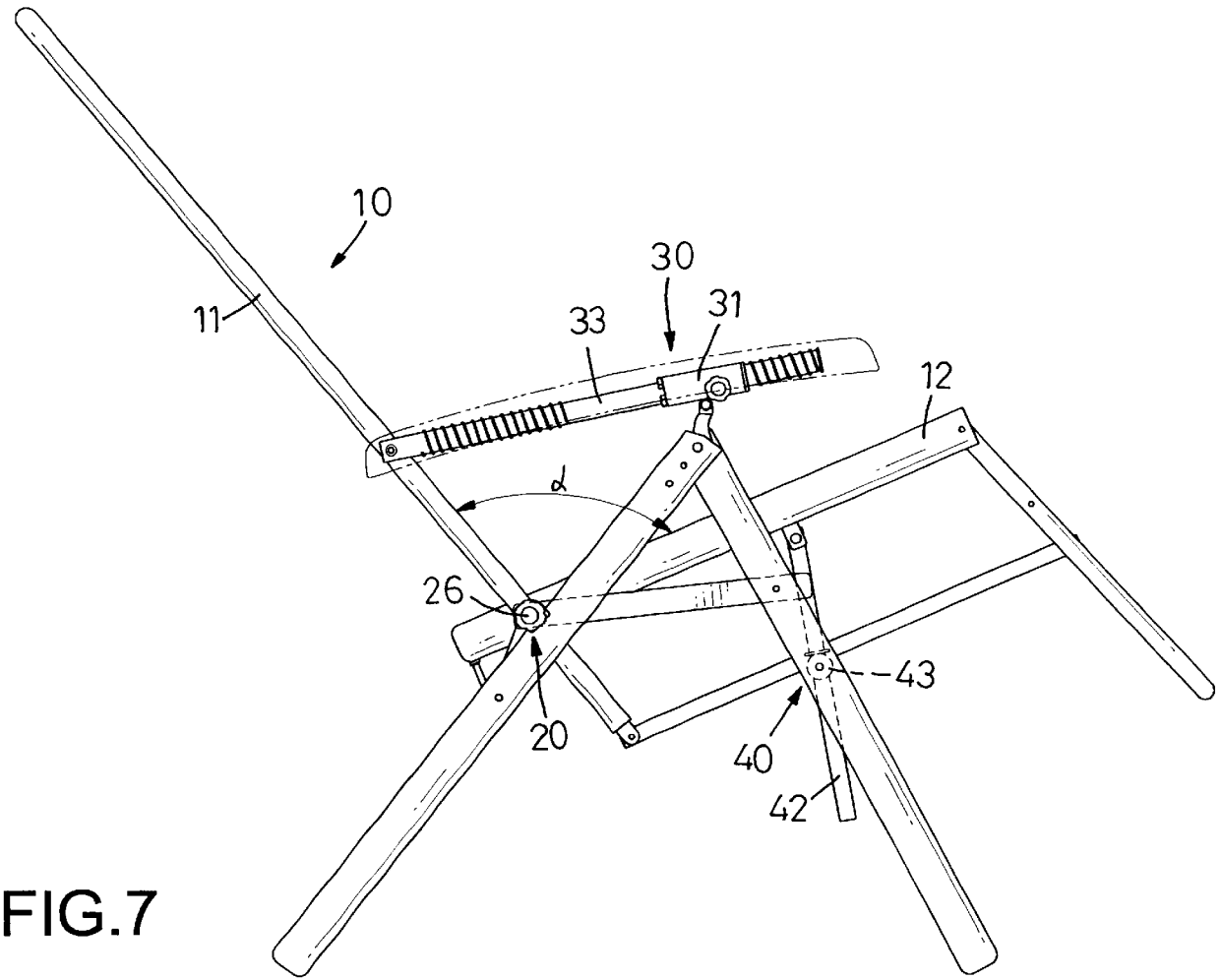
FIG. 7 is another side view showing the back frame and the seat frame are pivoted with the changeless included angle.

Referring to FIGS. 6 and 7, when the deck chair in accordance with the invention is assembled, there is an included angle ( ) between the back frame (11) and the seat frame (12). Because the first teeth (231) of the first disks (23) are respectively engaged with the second teeth (241) of the second disks (24), the back frame (11) is secured to the seat frame (12). Therefore, the back frame (11) along with the seat frame (12) can be pivoted about the threaded parts (263) of the knobs (26) with the changeless included angle ( ). In this case, the first rods (33) are respectively moved along the tubes (31), and the second rods (42) are respectively moved along the rotating pieces (43).

Figure 8:
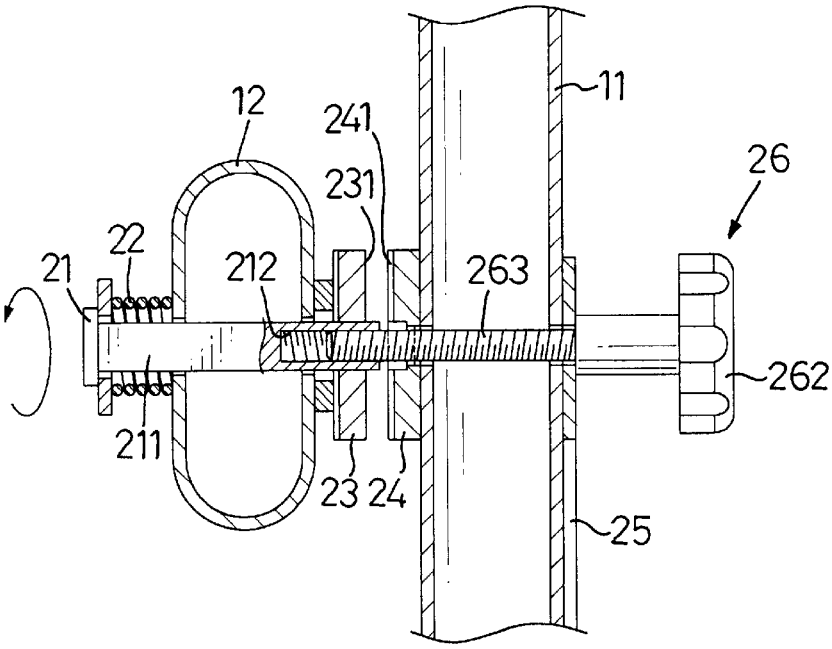
FIG. 8 is a cross-sectional view of the positioning member in an unlocked status.
Figure 9:
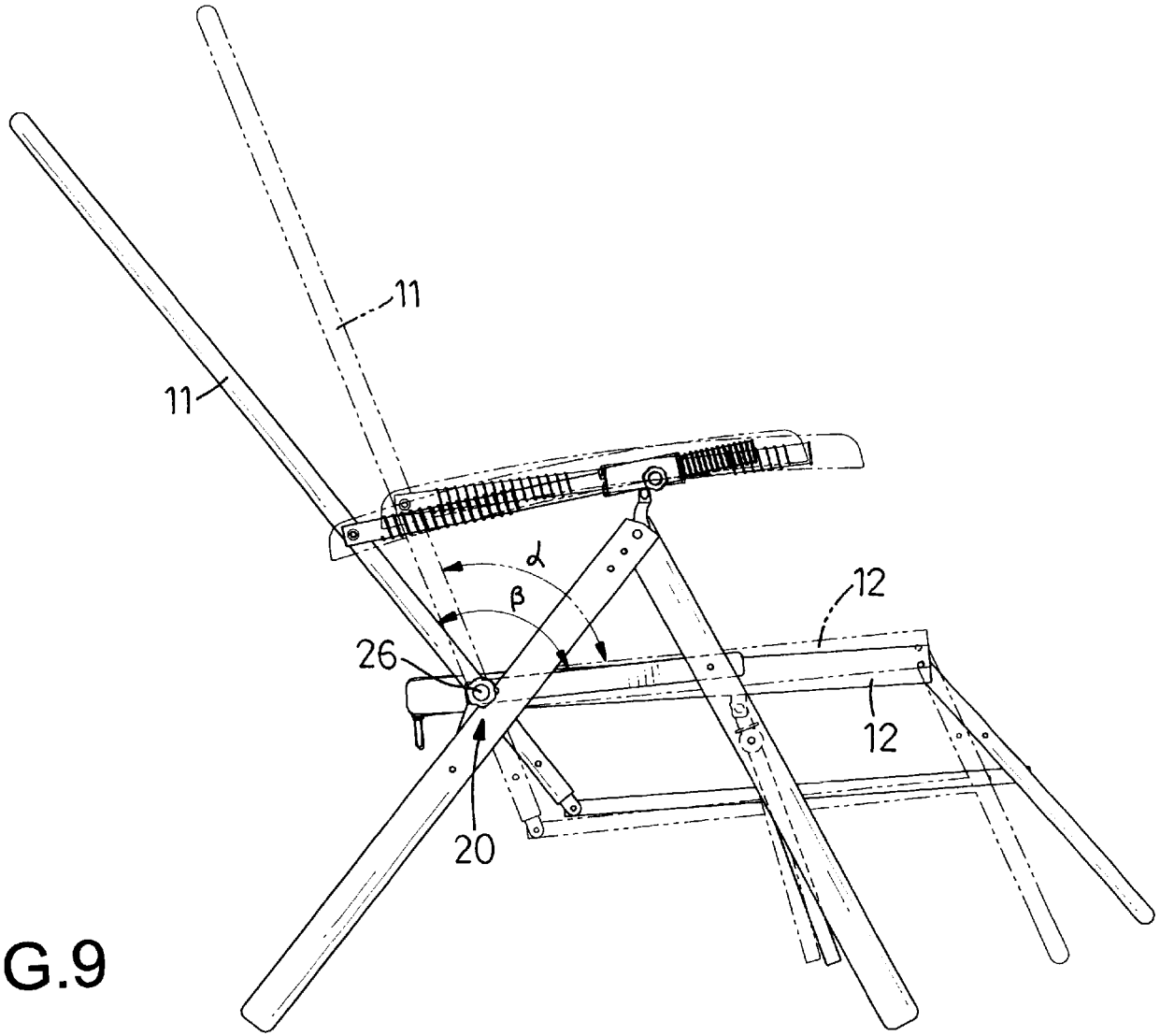
FIG. 9 is a side view showing that the back frame is pivoted about the seat frame to adjust the included angle.
Figure 10:
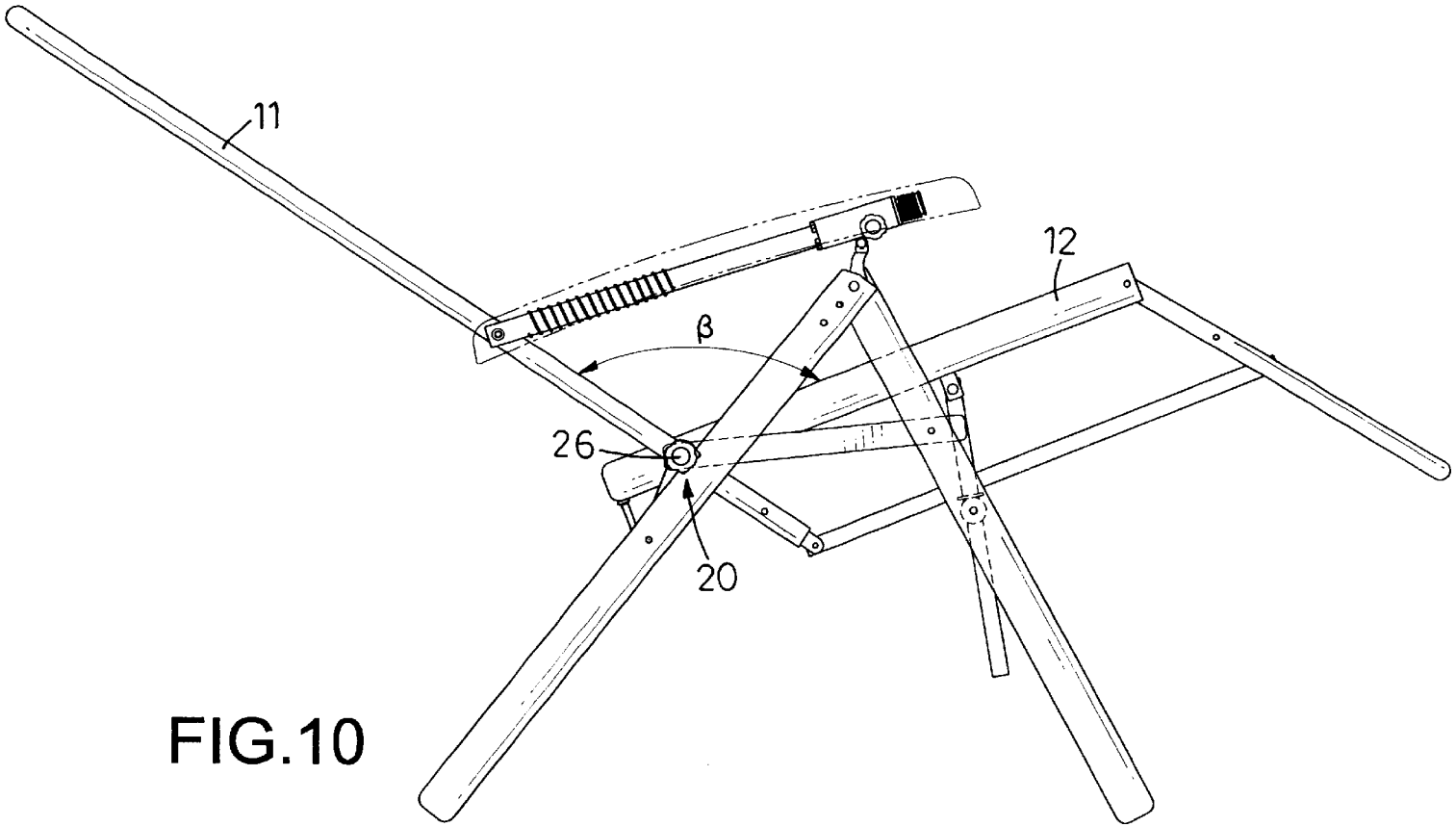
FIG. 10 is a side view showing that the back frame and the seat are pivoted with the adjusted included angle.

Referring to FIG. 8, when a user wants to adjust the included angle between the back frame (11) and the seat frame (12), the knobs (26) are loosened to disengage the first teeth (231) from the second teeth (241). Referring to FIG. 9, the back frame (11) can be pivoted about the seat frame (12) at an included angle ( ). Thereafter, the knobs (26) are tightened to engage the first teeth (231) with the second teeth (241), and the back frame (11) is secured to the seat frame (12) again. Thus, the back frame (11) along with the seat frame (12) can be pivoted about the threaded parts (263) of the knobs (26) with the changeless included angle ( ). In this case, the first rods (33) also are respectively moved along the tubes (31), and the second rods (42) also are respectively moved along the rotating pieces (43).

Figure 11:
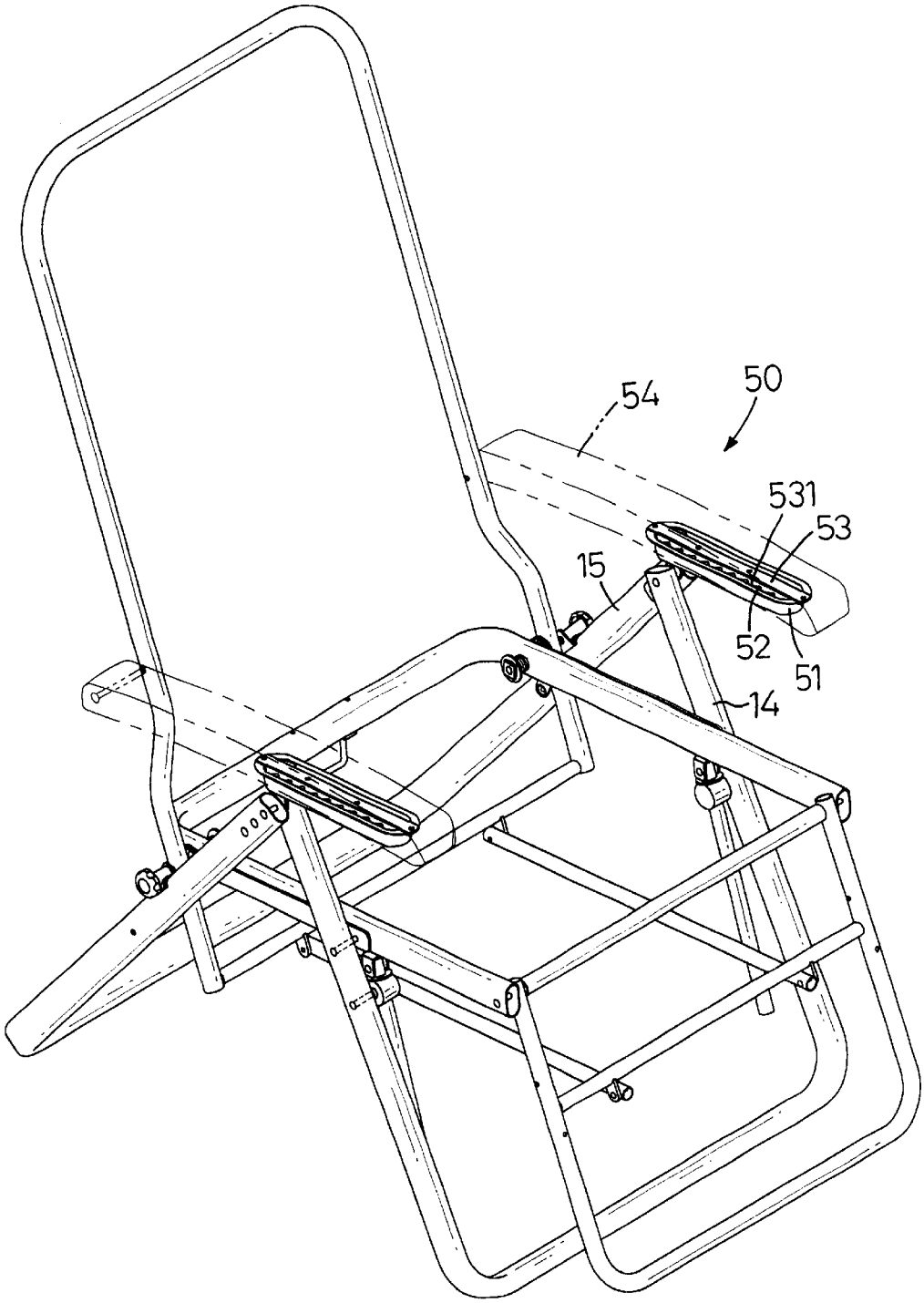
FIG. 11 is a perspective view of a second embodiment of the deck chair in accordance with the invention.
Figure 12:
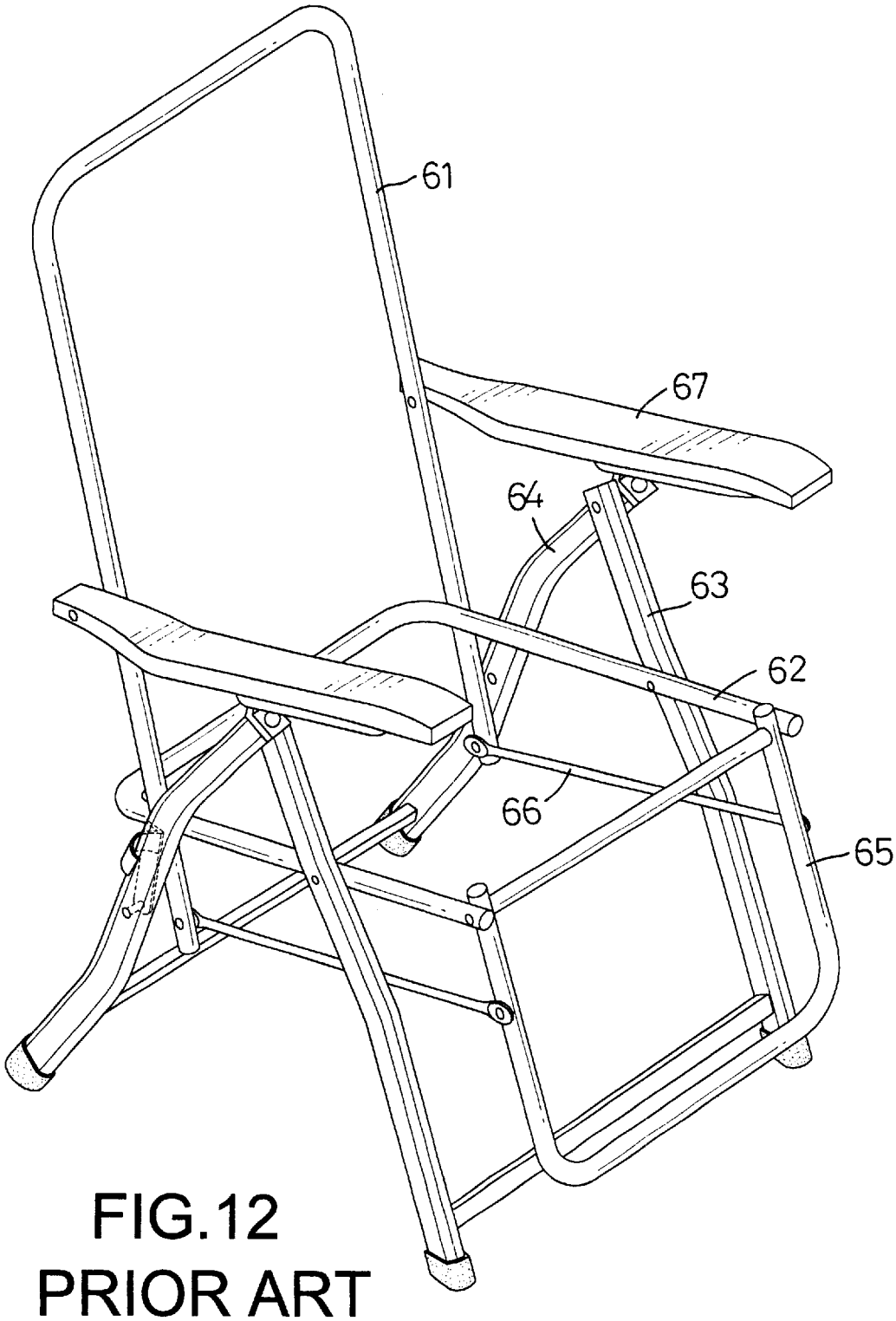
FIG.12 PRIOR ART
FIG. 12 is a perspective view of a conventional deck chair.
Figure 13:
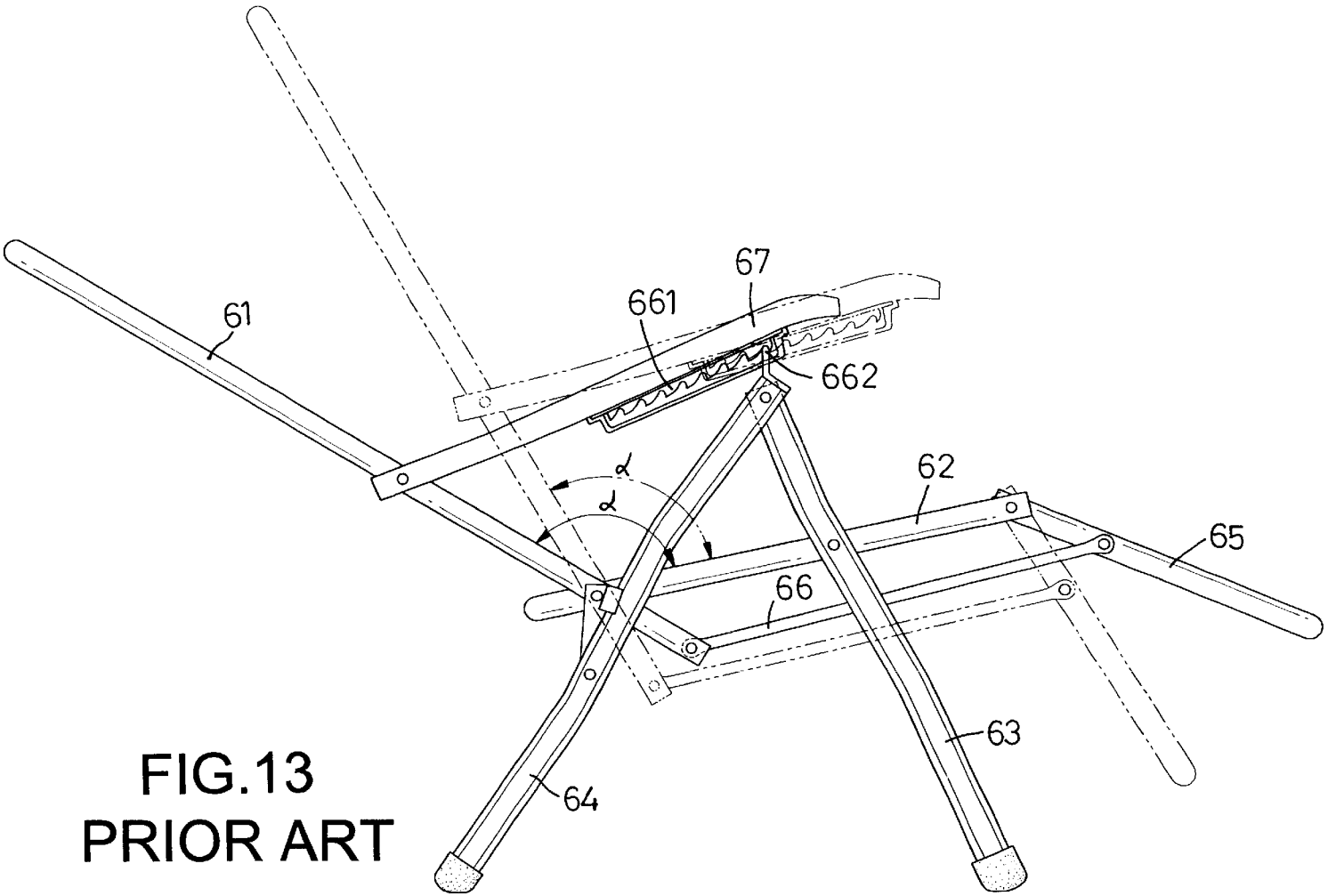
FIG.13 PRIOR ART
FIG. 13 is a side view showing that a back frame of the conventional deck chair is pivoted about a seat frame.

Referring to FIG. 11, in another embodiment of the invention, the armrest-adjusting members (50) each have a bottom plate (51) pivotally mounted on the respective top ends of the front support frames (14) and the rear support frames (15). A locking piece (52) is formed on the bottom plate (51). A movable piece (53) has a plurality of third teeth (531) formed at a bottom surface thereof and engaged with the locking piece (52). An armrest (54) is secured on the movable piece (53). Therefore, when the back frame (11) and the seat frame (12) are pivoted, the armrests (54) can be respectively moved along the bottom plates (51), and can be locked at a desired position by the third teeth (531) stopped by the locking pieces (52).

According to the present invention, the user can adjust the included angle between the back frame and the seat frame fitting himself, and lie on the deck chair with the changeless included angle after locking the positioning members.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A deck chair comprising:

a frame (10) having a back frame (11) with two upright bars (111) and a lateral bar (not numbered) integrally formed between the upright bars (111), a seat frame (12) having two longitudinal bars (121) respectively pivotally mounted with the upright bars (111), a leg frame (13) pivotally mounted at a front end of the seat frame (12), a front support frame (14) pivotally mounted outside the seat frame (12), a rear support frame (15) outside the back frame (11) having top ends pivotally mounted with top ends of the front support frame (14), and two side stretchers (16) each having a front end mounted on the front support frame (14), and a rear end mounted between the respective upright bar (111) and the longitudinal bar (121);

two positioning members (20) respectively to pivotally mount the upright bars (111) to the longitudinal bars (121); and two armrest-adjusting members (30) respectively pivotally mounted at top ends of the front support frame (14) and the rear support frame (15).

2. The deck chair as claimed in claim 1, wherein the upright bars (111) each have a first hole (113) and a second hole (114) above the first hole (113) defined therethrough, the longitudinal bars (121) each have a non-circular hole (122) defined therethrough and aligned with the first holes (113), and the positioning members (20) are respectively mounted in the first holes (113) and the non-circular holes (122).

3. The deck chair as claimed in claim 2, wherein the armrest-adjusting members (50) each have a bottom plate (51) pivotally mounted on the respective top ends of the front support frame (14) and the rear support frame (15), a locking piece (52) formed on the bottom plate (51), a movable piece (53) having a plurality of third teeth (531) formed at a bottom surface of the movable piece (53) and engaged with the locking piece (52), and an armrest (54) secured on the movable piece (53).

4. The deck chair as claimed in claim 2, wherein each of the positioning members (20) has a shaft (21) with a non-circular shank (211) inserted through the respective non-circular hole (122) from an inside of the seat frame (12), a threaded hole (212) defined through the shank (211), a first resilient member (22) provided outside the shank (211) and between the longitudinal bar (121) and the shaft (21), a first disk (23) and a second disk (24) provided between the side stretcher (16) and the upright bar (111), each disk (23, 24) having a non-circular aperture (232, 242)

for the shank (211) extending through the apertures (232, 242), the firs disk (23) having a plurality of first teeth (231) engaged with a plurality of second teeth (241) formed on the second disk (24), a link (25) having an upper end pivotally mounted on the upright bar (111) by a knob (26), and a lower end pivotally mounted on the rear support frame (15) by a pin, and the knob (26) having a threaded part (263) in turn inserted through the upper end of the link (25), the first hole (113), the non-circular apertures (241, 231), the non-circular hole (122), and engaged in the threaded hole (212) to fasten the positioning member (20) on the back frame (11) and the seat frame (12).

5. The deck chair as claimed in claim 4, wherein the link (25) has an ear (253) formed at the upper end thereof and abutting the rear support frame (15).

6. The deck chair as claimed in claim 2, wherein the armrest-adjusting member (30) has a tube (31) pivotally mounted on top ends of the front support frame (14) and the rear support frame (15), a sleeve (32) received in the tube (31), a first rod (33) inserted through the sleeve (32) and the tube (31), the first rod (33) having a stop (331) formed at a front end of the first rod (33), and a pin hole (332) defined at a rear end of the first rod (33) and aligned with the second hole (114), a pin inserted through the pin hole (332) and the second hole (114) to connect the first rod (33) to the back frame (11), a second resilient member (34) provided outside the first rod (33) and between the stop (331) and the sleeve (32), a third resilient member (35) provided outside the first rod (33) and between the sleeve (32) and the third pin hole (332), a bolt (36) engaged in the tube (31) for fastening the first rod (33) in the tube (31), an armrest (37) mounted on the tube (31).

7. The deck chair as claimed in claim 6, wherein the sleeve (32) has a head (321) located at a front end of the tube (31), a first opening (322) defined through the head (321) for the first rod (33) extending therethrough, a plurality of fingers (323) extending rearwards from the head (321), and a barb (324) formed at a distal end of the respective finger (323) to attach a rear end of the tube (31).

8. The deck chair as claimed in claim 6, wherein the tube (31) has a pivoting piece (311) formed at a bottom thereof and pivotally mounted between top ends of the front support frame (14) and the rear support frame (15).

9. The deck chair as claimed in claim 1 further comprising two pivoting members (40) respectively mounted between the longitudinal bars (121) and the front support frame (14).

10. The deck chair as claimed in claim 7, wherein each of the pivoting members (40) has a U-shaped seat (41) formed under the respective longitudinal bar (121), a second rod (42) pivotally mounted in the U-shaped seat (41) by a pin (not numbered) inserted through an upper end of the second rod (42), a rotating piece (43) rotatably provided at an inner side of the front support frame (14), and a second opening (431) defined through the rotating piece (43) for the second rod (42) extends through the second opening (431).

11. The deck chair as claimed in claim 1, wherein the back frame (11) has a first linkage (112) transversally connected between lower ends of the upright bars (111), and the leg frame (13) has a front stretcher (131) provided therein and connected with the first linkage (112) by two second linkages (132).

* * * * *